US007861472B2

(12) United States Patent
Thompson

(10) Patent No.: US 7,861,472 B2
(45) Date of Patent: Jan. 4, 2011

(54) MOUNTING APPARATUS FOR PROTECTIVE COVERS

(76) Inventor: Guy Carl Thompson, 3145 Leroy Rd., Maurice, LA (US) 70555

( * ) Notice: Subject to any disclaimer, the term of this patent is extended or adjusted under 35 U.S.C. 154(b) by 0 days.

(21) Appl. No.: 12/150,793

(22) Filed: May 1, 2008

(65) Prior Publication Data

US 2009/0272061 A1 Nov. 5, 2009

(51) Int. Cl.
*E06B 3/26* (2006.01)
*E06B 3/00* (2006.01)

(52) U.S. Cl. ..... 52/208; 52/202

(58) Field of Classification Search ..... 52/202, 52/203, 208, 127.8, 106; 292/194, 240, 256, 292/257; 160/368.1, 327, 369; 49/463, 465, 49/61, 62, 63; 269/3, 6, 67, 69, 79, 143, 269/231, 249; 411/349, 549, 552
See application file for complete search history.

(56) References Cited

U.S. PATENT DOCUMENTS 377,013 A * 1/1888 Brooks ..... 49/371
600,870 A * 3/1898 Hauser ..... 160/369
741,721 A * 10/1903 Rumford ..... 292/256.71
934,488 A * 9/1909 Watrous ..... 292/202
1,101,867 A * 6/1914 McCorkindale ..... 292/238
1,329,427 A * 2/1920 Otto ..... 52/127.8
1,551,311 A * 8/1925 Klein et al. ..... 292/212
1,765,614 A * 6/1930 Roberts et al. ..... 292/194
1,783,150 A * 11/1930 Jeffery ..... 292/240
2,414,272 A * 1/1947 Poupitch ..... 411/549
2,569,941 A * 10/1951 Mastrangelo et al. ..... 52/127.8
2,794,217 A 6/1957 Croft
2,900,678 A * 8/1959 Curtis ..... 52/127.8
3,460,210 A * 8/1969 Ellis ..... 411/552
4,139,972 A * 2/1979 Naka ..... 52/208
4,174,596 A 11/1979 Deibele
5,137,406 A * 8/1992 Cosenza ..... 411/113
5,205,520 A * 4/1993 Walker ..... 248/74.1
5,249,983 A * 10/1993 Hirai ..... 439/573
5,251,098 A * 10/1993 Schmidt ..... 361/717
5,341,860 A 8/1994 Klein
5,366,329 A * 11/1994 Burgess ..... 411/368
5,507,118 A 4/1996 Brown
5,673,883 A 10/1997 Figueroa, Jr.
5,704,816 A * 1/1998 Polidori ..... 439/781
5,794,897 A * 8/1998 Jobin et al. ..... 248/74.4
5,918,430 A 7/1999 Rowland (Continued)

FOREIGN PATENT DOCUMENTS

DE 202 08 217 U1 11/2002

(Continued)

*Primary Examiner*—Richard E Chilcot, Jr.
*Assistant Examiner*—Andrew J Triggs
(74) *Attorney, Agent, or Firm*—Ted M. Anthony

(57) ABSTRACT

An inexpensive device is provided for quickly and efficiently securing protective panels such as, for example, plywood and the like, to exterior surfaces of buildings to protect windows, doors and/or other vulnerable features from wind and flying debris. The device comprises a stationary base, and a clamping member attached to such base. At least one device of the present invention is mounted to a building in general proximity to a window, door or other feature to be covered with a protective panel; the clamping member(s) secure the protective panels in place against the building. When not in use, the present invention can be maintained in a stowed position.

6 Claims, 3 Drawing Sheets

U.S. PATENT DOCUMENTS

| | | | | |
|---|---|---|---|---|
| 5,937,593 | A | 8/1999 | White | |
| 6,196,037 | B1 * | 3/2001 | Urschel et al. | 70/416 |
| 6,233,877 | B1 | 5/2001 | Monroe | |
| 6,330,768 | B1 | 12/2001 | Rodrigues | |
| 6,371,422 | B1 | 4/2002 | St. Martin et al. | |
| 6,640,509 | B2 | 11/2003 | Clewis | |
| 6,679,646 | B2 * | 1/2004 | Quardt et al. | 403/348 |
| 6,955,344 | B2 * | 10/2005 | Brass et al. | 269/45 |
| 2003/0110718 | A1 * | 6/2003 | Boisvert | 52/208 |
| 2006/0179736 | A1 | 8/2006 | Bieber et al. | |
| 2007/0000193 | A1 | 1/2007 | Beaupre | |
| 2008/0110099 | A1 * | 5/2008 | Famulare et al. | 49/465 |

FOREIGN PATENT DOCUMENTS

| | | |
|---|---|---|
| GB | 2 398 335 | 8/2004 |

* cited by examiner

MOUNTING APPARATUS FOR PROTECTIVE COVERS

CROSS REFERENCES TO RELATED APPLICATION

None

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention relates to an apparatus for mounting protective material to buildings, dwellings and other structures. More particularly, the present invention relates to an apparatus that permits rapid and convenient mounting of protective coverings over windows, doors and/or other features of buildings, dwellings and other structures.

2. Brief Description of the Prior Art

Hurricanes, storms and other violent weather events can cause serious bodily injury and death, as well as significant damage to property. With modern weather tracking and forecasting tools, inhabitants frequently receive advance warning of approaching hurricanes, storms or other violent weather events. In such cases, prior to the arrival of the storm or other weather event, people will frequently attempt to safeguard their person or property by temporarily mounting protective coverings over doors, windows and/or other vulnerable features of buildings, dwellings and/or other structures.

In many cases, such efforts involve securing storm covers—frequently comprising panels constructed of plywood or other similar materials—to vertical exterior surfaces of such buildings, dwellings and/or other structures. Although such storm covers can be secured to buildings or other structures at multiple different locations, in most cases the storm covers are temporarily mounted over doors, windows, or other breakable features of such buildings or other structures. When installed, such storm covers provide a rigid protective barrier to shield glass and other breakable features from wind damage and/or flying debris. After the storm or other threat passes, such storm covers can be removed and discarded, or stored for reuse during the next storm or other violent weather event.

Although such storm covers are typically temporarily mounted over windows, doors and/or other features, existing mounting methods generally require a substantial amount of time, effort and expense to accomplish. In many cases, property owners secure wooden storm panels over windows, doors or other openings using nails, wood screws, or other similar fasteners. After the wooden panels are measured and cut to desired dimensions, the edges of such panels are nailed or screwed directly to external surfaces or wooden components of a building, dwelling or other structure. One disadvantage of this approach is that installation of such storm panels can cause serious damage to the building or other structure; after the storm panels are removed, the holes caused by such nails or other fasteners must be filled, and the surfaces of the building or other structure typically must be repaired.

Another existing method of mounting storm panels involves embedding anchor bolts into the external surfaces of the buildings, dwellings or other structures to be protected, especially on brick veneer surfaces where nails or other similar fasteners do not represent a viable option. Such bolts protrude from such external surfaces at predetermined locations. However, such exposed bolts can frequently detract from the aesthetic appearance of the building, dwelling or other structure. Further, over time, such exposed bolts can be susceptible to rust or other weathering effects that can make such bolts difficult to use. Moreover, placement of such bolts is critical, since attachment points on the storm panel must be carefully measured to ensure that all the bolts will align with corresponding apertures in the storm panels.

Existing methods of mounting storm panels can be time consuming and expensive. Measuring and nailing plywood to the external surface of buildings or other structures can be hard work. Similarly, measuring and customizing storm panels so that they can be properly aligned with, and attached to, embedded bolts can also be time consuming and difficult work. In certain locations, such as hurricane-prone areas, property owners may be required to repeat these processes several times a year. Further, depending on the amount of advance notice, such work must frequently be performed in a relatively short amount of time.

In light of the foregoing, it is desirable to have an inexpensive and easy to use apparatus for temporarily but securely mounting storm panels to buildings, dwellings and/or other structures to protect against harmful effects of storms or violent weather. Such apparatus should work with many different sizes of panels, and should not cause permanent damage to buildings, dwellings and/or other structures. Further, such apparatus should be inexpensive and aesthetically pleasing, and should permit both rapid installation and removal of such storm panels.

SUMMARY OF THE PRESENT INVENTION

The present invention comprises a novel mounting apparatus for quick and efficient securing of protective storm panels, such as plywood and the like, to the exterior surfaces of buildings, dwellings and/or other structures. Although such protective storm panels can be affixed to virtually any location on a building, dwelling or other structure, said protective panels are typically used to cover doors, windows, and/or other openings or vulnerable features. The mounting apparatus of the present invention is inexpensive, easy to use and can be utilized to mount many different sizes, shapes and configurations of protective panels to surfaces, including external vertical surfaces, of buildings, dwellings and other structures. Further, the apparatus of the present invention is aesthetically pleasing, and permits rapid installation and removal of protective panels from such buildings, dwellings or other structures being covered.

In the preferred embodiment, the mounting apparatus of the present invention comprises two primary components: a base member, and a clamp member. In the preferred embodiment, the base member comprises an elongate member having a first end, a second end, a top and a bottom. As discussed in greater detail below, a plurality of apertures is disposed through said base member.

In the preferred embodiment, said bottom of said base member defines a substantially level outer surface. A first projection extends from the top of said base at said first end, while a second projection extends from the top of said base at said second end. A space or gap is formed between said first and second projections, substantially at the mid-point between said first and second ends of said base.

In the preferred embodiment, said clamp member comprises a substantially hollow elongate member having a first end, a second end, a top and a bottom. The top of said clamp member is rounded at said first and second ends, thereby defining substantially convex outer surfaces at said first and second ends. The bottom of said clamp member defines a central recess. When said clamp member is placed over said base member, and the longitudinal axes of said two members are aligned, said base member substantially fits within said recess of said clamp member. Put another way, when the longitudinal axes of said two members are aligned, said clamp member substantially fits over and covers said base member. A central aperture, located substantially at the midpoint between said first and second ends of said clamp member, extends from said top of said clamp member to said bottom of said clamp member.

An elongate fastener such as, for example, a threaded bolt, is received through an aperture of said base member and said central aperture of said clamp member. A nut such as, for example, a wing nut is threadably disposed on said elongate bolt near the top of said clamp member. When said wing nut is tightened on said fastener bolt, said clamp member and base member can be drawn together. Conversely, when said wing nut is loosened on said elongate bolt, said clamp member can be separated from said base (at least as far as the length of said elongate bolt). When said clamp member is separated from said base member, said clamp member is permitted to spin about said elongate bolt.

In operation, at least one mounting apparatus of the present invention is affixed to the exterior surface of a structure. In the preferred embodiment, said elongate base of the present invention is first anchored to such surface using bolts or other fasteners received through apertures in said base member. Thereafter, said clamp member can be affixed to said base member using an elongate bolt or other fastener as described above.

In most cases, the number and placement of the mounting devices of the present invention is dictated by the size, shape and type of door, window or other opening or feature being covered. Generally, the mounting apparatus of the present invention can be mounted adjacent to and in general proximity to the feature to be covered. In most cases, the mounting apparatus of the present invention should be mounted approximately 3 to 4 inches from the opening to be covered, so that when the clamp member is tightened down on the protective panel, a portion of said panel is wedged or secured between the clamp and the external surface of the structure surrounding the opening being protected.

The mounting apparatus of the present invention can be oriented in two basic positions. In the "stowed" position, the longitudinal axis of said clamp member is aligned with the longitudinal axis of said base member; in this position, said clamp member substantially covers said base member. Further, in the stowed position, said projections of said base are received within said central recess along the bottom of said clamp member, thereby preventing said clamp member from turning or spinning about its central axis. In most cases, the mounting apparatus of the present invention is maintained in the stowed position during periods when it is not being used to hold or secure a protective panel.

In the "clamping" position, said clamp member is oriented substantially perpendicular relative to the longitudinal axis of said base member. In the clamping position, said clamp member is disposed within the gap formed between said first and second projections of said base member. In this position, said first and second projections act against the sides of said clamp member and prevent said clamp member from spinning about said elongate central bolt. In most cases, the mounting apparatus of the present invention is maintained in the clamping position during periods when it is actually being used to hold or secure a protective panel against a building, dwelling or other structure.

BRIEF DESCRIPTION OF THE DRAWINGS

The foregoing summary, as well as the following detailed description of the preferred embodiments, is better understood when read in conjunction with the appended drawings. For the purpose of illustrating the invention, the drawings show certain preferred embodiments. It is understood, however, that the invention is not limited to the specific methods and devices disclosed.

DETAILED DESCRIPTION OF A PREFERRED EMBODIMENT OF THE INVENTION

The present invention comprises a novel mounting apparatus for quick and efficient securing of protective storm panels, such as plywood and the like, to the exterior surfaces of buildings, dwellings and/or other structures. Although such protective storm panels can be affixed to virtually any location on a building, dwelling or other structure, said protective panels are typically used to cover doors, windows, and/or other openings or vulnerable features. The mounting apparatus of the present invention is inexpensive, easy to use and can be utilized to mount many different sizes, shapes and configurations of protective panels to buildings, dwellings and other structures. Further, the apparatus of the present invention is aesthetically pleasing, and permits rapid installation and removal of protective panels from buildings, dwellings or other structures being covered.

Figure 1:
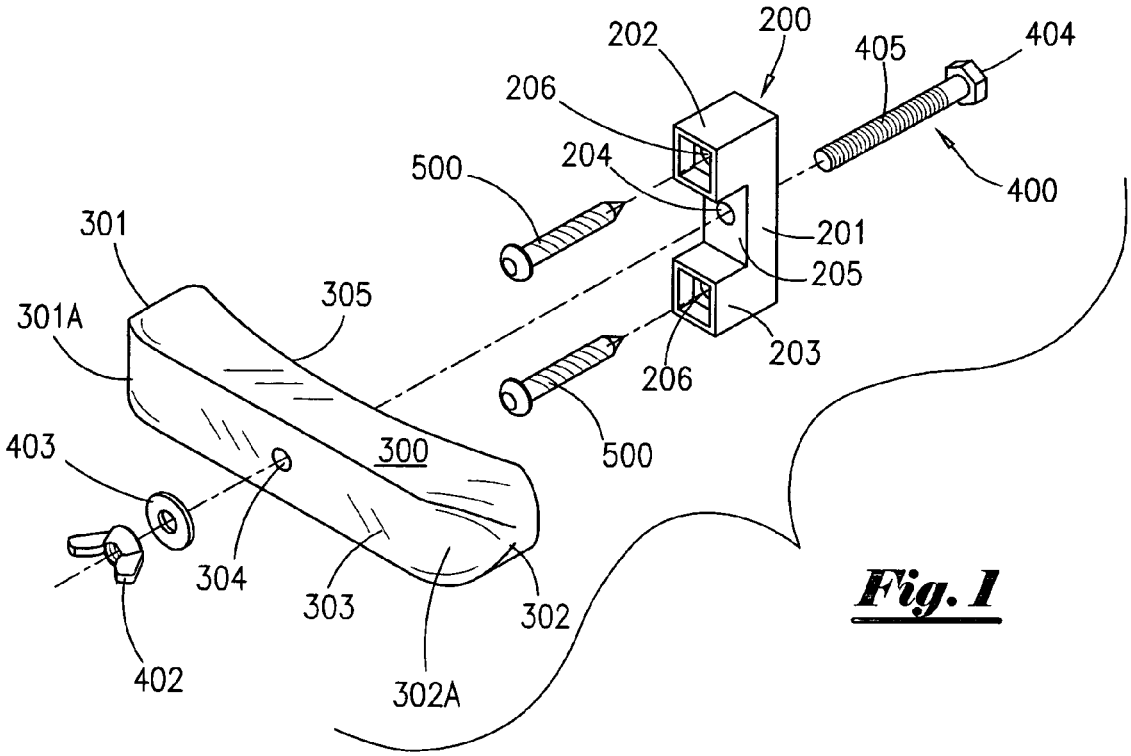
FIG. 1 depicts an exploded perspective view of a mounting apparatus of the present invention.

Referring to the drawings, FIG. 1 depicts an exploded perspective view of the mounting apparatus of the present invention. In the preferred embodiment, the mounting apparatus of the present invention comprises base member assembly 200 and clamp member assembly 300. In the preferred embodiment, base member assembly 200 has substantially rectangular body section 201 with first substantially rectangular projection 202 disposed at one end of body section 201, and second substantially rectangular projection 203 disposed at the opposite end of body section 201. A gap exists between said first projection 202 and second projection 203, with substantially flat upper surface 205 of body section 201. In the preferred embodiment, central aperture 204 extends through body section 201; central aperture 204 is situated at or near the mid-point between said first projection 202 and said second projection 203.

Although partially obscured from view in FIG. 1, anchor apertures 206 extend through said first projection 202 and said second projection 203. Said anchor apertures 206 can receive fasteners 500. Although fasteners 500 are depicted as threaded wood screws in FIG. 1, it is to be observed that said fasteners 500 can be other types of fasteners known in the art including, without limitation, mortar bolts or nails. In most instances, the precise type of fasteners 500 will be dictated by the particular type of surface into which said base member assembly 200 is to be anchored.

In the preferred embodiment, clamp member assembly 300 comprises a substantially hollow and elongate member having a first end 301, a second end 302 and an upper surface 303. Said upper surface 303 is beneficially rounded at said first end 301 and second end 302, thereby defining convex outer surfaces 301A and 302A, respectively. Clamp member assembly 300 is substantially hollow and has concave lower surface 305.

When the longitudinal axes of said base member assembly 200 and clamp member assembly 300 are aligned, said base member assembly 200 can be received within the recess formed inside the substantially hollow structure of clamp member assembly 300. In such configuration, said base member assembly 200 substantially fits within the recess formed by substantially hollow clamp member assembly 300. Put another way, when the longitudinal axes of said base member assembly 200 and clamp member assembly 300 are aligned, said clamp member assembly 300 substantially fits over and covers said base member assembly 200. Central aperture 304, located substantially at the mid-point between said first end 301 and second end 302 of clamp member 300, extends through said upper surface 303 of clamp member 300.

Still referring to FIG. 1, elongate threaded bolt 400 having multi-sided head 404 and threaded section 405, is received through aligned aperture 204 of base member assembly 200 and central aperture 304 of clamp member assembly 300. Washer 403 and wing nut 402 is threadably received on threaded section 405 of said elongate bolt 400. When wing nut 402 is tightened on threaded section of 405 of bolt 400, said wing nut 402 and washer 403 act against upper surface 303 of clamp member assembly 300, thereby causing said clamp member assembly 300 and base member assembly 200 to be drawn together. Conversely, when said wing nut 402 is loosened on threaded section 405 of said elongate bolt 400, said clamp member assembly 300 can be separated from said base member assembly 200 (at least as far as the length of threaded section 405 of elongate bolt 400).

Figure 2:
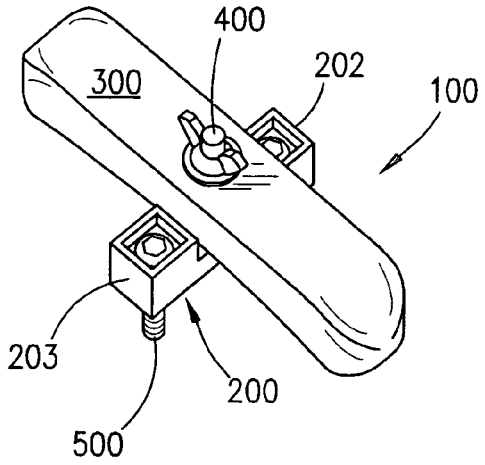
FIG. 2 depicts an overhead perspective view of a mounting apparatus of the present invention in a "clamping" position.

FIG. 2 depicts an overhead perspective view of mounting apparatus assembly 100 of the present invention in the "clamping" position. In this orientation, clamp member 300 is transverse to base member assembly; that is, the longitudinal axis of clamp member assembly 300 is oriented substantially perpendicular relative to the longitudinal axis of base member assembly 200. Further, in the clamping position, clamp member assembly 300 is disposed in the gap formed between first projection 202 and second projection 203 of body member assembly 200. Said first projection 202 and second projection 203 limit the ability of said clamp member assembly 300 to spin about elongate bolt 400. In most cases, mounting apparatus assembly 100 of the present invention is maintained in the clamping position depicted in FIG. 2 during periods when said mounting apparatus is actually being used to hold or secure a protective material against a building, dwelling or other structure.

Figure 3:
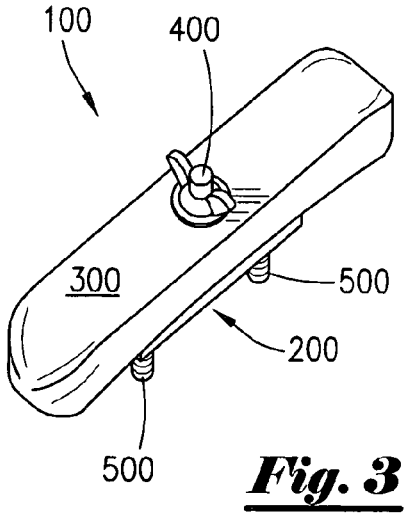
FIG. 3 depicts an overhead perspective view of a mounting apparatus of the present invention in a "stowed" position.

FIG. 3 depicts an overhead perspective view of mounting apparatus assembly 100 of the present invention in a "stowed" position. In the "stowed" position, the longitudinal axis of clamp member assembly 300 is substantially aligned with the longitudinal axis of base member assembly 200. In this orientation, clamp member assembly 300 essential covers and fits over base member assembly 200. Further, in the stowed position, said projections 202 and 203 (not visible in FIG. 3) of said base member assembly 200 are received within the recess formed within substantially hollow clamp member assembly 300, thereby preventing said clamp member assembly 300 from turning or spinning about elongate bolt 400. In most cases, mounting apparatus assembly 100 of the present invention is maintained in the stowed position during periods when it is not being used to hold or secure a protective panel.

Referring to FIGS. 2 and 3, it is to be observed that fasteners 500 extend beyond the lower surface of base member assembly 200. As such, said fasteners 500 can be used to penetrate into a surface (such as the external surface of a building, dwelling or other structure) to securely anchor said base member assembly 200 to such surface.

Figure 4:
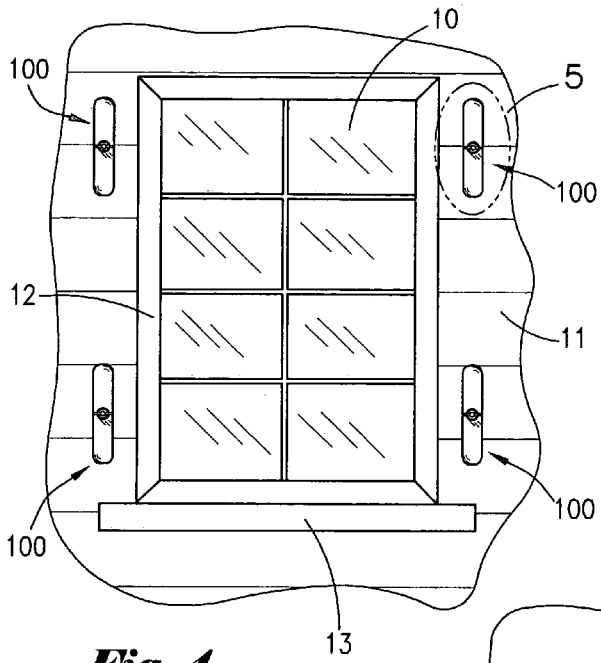
FIG. 4 depicts a side view of a plurality of mounting apparatuses of the present invention in the "stowed" position and disposed on the exterior surface of a structure.

FIG. 4 depicts a side view of a plurality of mounting apparatus assemblies 100 of the present invention oriented in the "stowed" position. As depicted in FIG. 4, a plurality of mounting apparatus assemblies 100 is arrayed around the outer periphery of window 10 on an exterior surface of building 11. In most cases, the number and placement of said mounting apparatus assemblies 100 will be dictated by the size, shape and type of opening (such as, for example, window 10) being covered. Generally, each mounting apparatus assembly 100 of the present invention can be mounted to any side of an opening.

In the preferred embodiment of the present invention, the mounting apparatus assemblies 100 of the present invention should be mounted approximately 3 to 4 inches from the opening to be covered. As such, the configuration/layout of mounting apparatus assemblies 100 depicted in FIG. 4 is for illustration purposes only, and should not be seen as limiting in any way.

Still referring to FIG. 4, although window 10 is depicted in FIG. 4 as a conventional, substantially rectangular multi-pane glass window 10 having exterior frame 12 and lower horizontal window ledge 13, it is to be observed that mounting apparatus assemblies 100 of the present invention are not limited to use on only windows. Rather, mounting apparatus assemblies 100 can be used to protect doors, openings and/or various other features found on buildings, dwellings and/or other structures. Further, although building 11 is generally depicted in FIG. 4 as a wooden building having external siding, it is to be observed that mounting apparatus assemblies 100 of the present invention can be used in connection with buildings, dwellings and/or other structures having other types of outer surfaces (including, without limitation, brick veneer surfaces).

Figure 5:
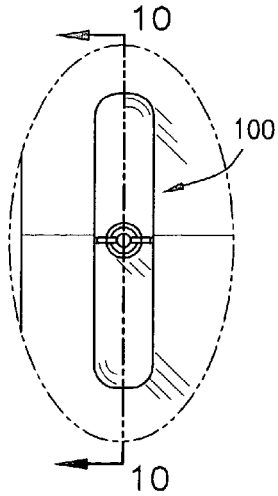
FIG. 5 depicts a detailed view of a mounting apparatus of the present invention depicted in FIG. 4.

FIG. 5 depicts a detailed view of a mounting apparatus assembly 100 of the present invention depicted in FIG. 4. Said mounting apparatus assembly 100 is shown in the "stowed" position. In most cases, mounting apparatus assemblies 100 of the present invention are maintained in the stowed position when not actively being used to secure a protective panel against a building, dwelling or other structure.

Figure 7:
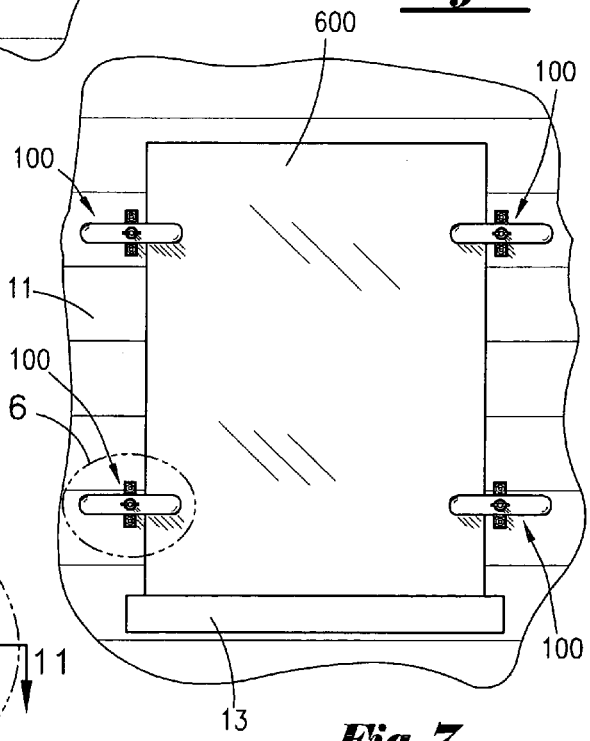
FIG. 7 depicts a side view of a plurality of mounting apparatuses of the present invention in the "clamping" position and disposed on the exterior surface of a structure.

FIG. 7 depicts a side view of a plurality of mounting apparatus assemblies 100 of the present invention disposed on the exterior surface of building 11, similar to the view depicted in FIG. 4. However, in FIG. 7, said mounting apparatus assemblies 100 are securing panel 600 to the exterior surface of building 11, and holding said panel 600 in place over window 10 and frame 12 (obscured from view in FIG. 7). Although panel 600 can be constructed of any number of rigid, sufficiently strong and relatively lightweight materials that could shield and adequately protect underlying vulnerable features of building 11 (such as, for example, window 10) from wind and/or flying debris, in the preferred embodiment panel 600 comprises a sheet of conventional plywood sized to fit over window 10 and frame 12.

Still referring to FIG. 7, panel 600 is depicted as resting upon horizontal window ledge 13. However, it is to be observed that panel 600 can be installed over window 10 even in the absence of said horizontal window ledge 13. In such circumstances, at least one mounting apparatus assembly 100 can be disposed on the exterior surface of building 11 below window 10 (or such other feature to be protected by panel 600). Although not depicted as such in FIG. 7, under this scenario, the weight of panel 600 can be permitted to rest upon, and be supported by, said at least one mounting apparatus assembly 100 positioned below window 10.

Figure 6:
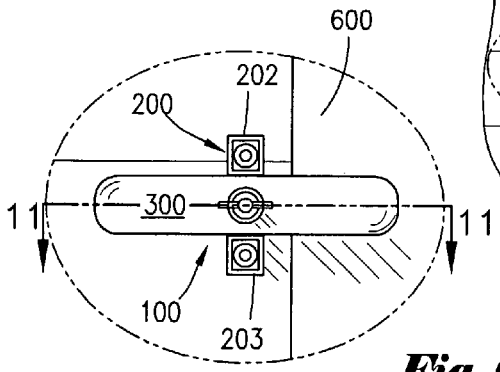
FIG. 6 depicts a detailed view of a mounting apparatus of the present invention depicted in FIG. 7.

FIG. 6 depicts a detailed view of a mounting apparatus assembly 100 of the present invention depicted in FIG. 7. In FIG. 6 (and FIG. 7), mounting apparatus assembly 100 of the present invention is depicted in the "clamping" position. In the clamping position, clamp member assembly 300 is oriented transverse (that is, substantially perpendicular) relative to the longitudinal axis of base member assembly 200. Further, said clamp member assembly 300 is disposed in the gap formed between first projection 202 and second projection 203 of said base member 200. In this position, said first projection 202 and second projection 203 act against the sides of clamp member assembly 300 and prevent said clamp member assembly 300 from spinning about elongate bolt 400.

Figure 8:
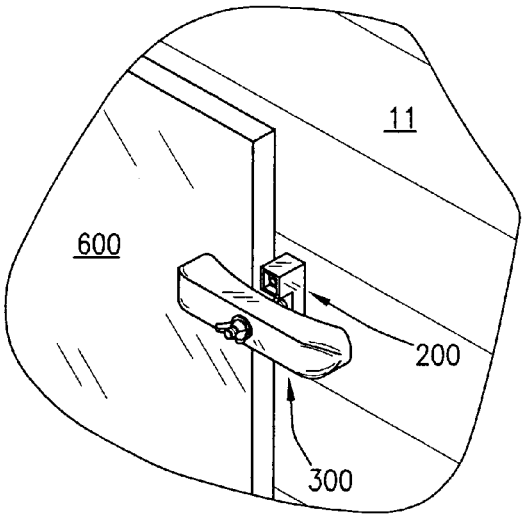
FIG. 8 depicts a side perspective view of a mounting apparatus of the present invention in the "clamping" position and disposed on the exterior surface of a structure.
Figure 9:
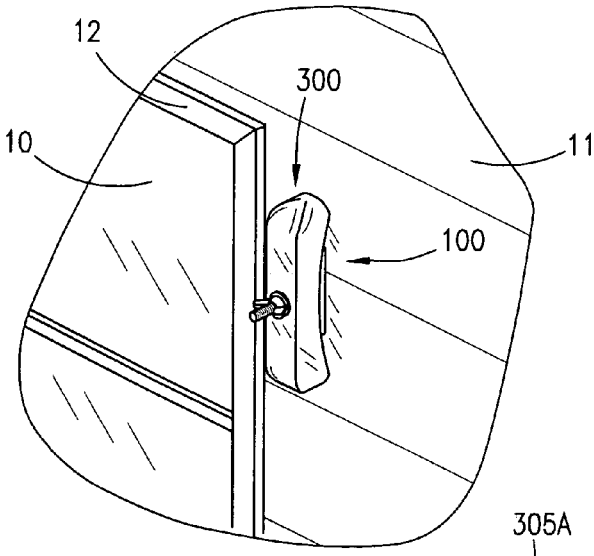
FIG. 9 depicts a side perspective view of a mounting apparatus of the present invention in the "stowed" position and disposed on the exterior surface of a structure.

FIG. 8 depicts a side perspective view of a mounting apparatus assembly 100 of the present invention in the "clamping" position and disposed on exterior surface of building 11. FIG. 9 depicts a side perspective view of mounting apparatus assembly 100 of the present invention in the "stowed" position and disposed on the exterior surface of building 11.

Figure 10:
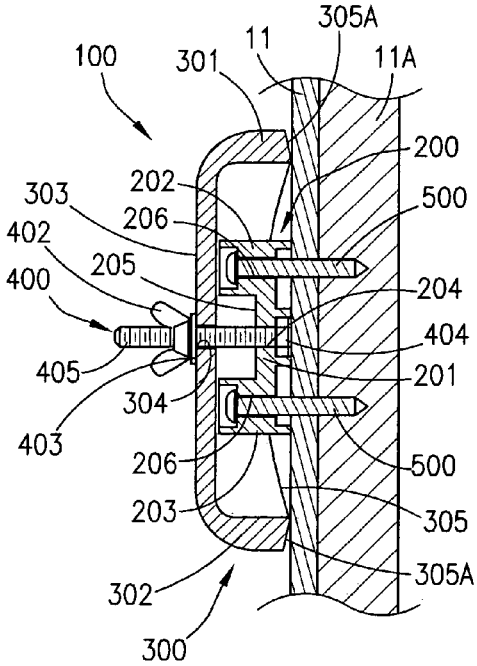
FIG. 10 depicts a side sectional view of the mounting apparatus of the present invention depicted in FIG. 5 along line 10-10.

FIG. 10 depicts a side sectional view of the mounting apparatus of the present invention depicted in FIG. 5 along line 10-10. In the preferred embodiment, mounting apparatus assembly 100 comprises base member assembly 200 and a clamp member assembly 300. Base member assembly 200 has body section 201. First substantially rectangular projection 202 is disposed at one end of body section 201, while second substantially rectangular projection 203 is disposed at the opposite end of body section 201. A gap exists between said first projection 202 and second projection 203, thereby defining substantially flat upper surface 205 on body section 201. In the preferred embodiment, central aperture 204 extends through body section 201; said central aperture 204 is situated substantially at the mid-point between said first projection 202 and said second projection 203.

Fasteners 500 are received within apertures 206 of said first projection 202 and second projection 203, respectively. Said fasteners 500 extend beyond the lower surface of base member assembly 200 and penetrate into the exterior of building 11. In the preferred embodiment, said fasteners 500 penetrate beyond the outer surface covering of said building 11 and extend into structural member 11A of building 11 to more securely anchor base member assembly 200 to building 11.

When the longitudinal axes of said base member assembly 200 and clamp member assembly 300 are aligned, said base member 200 is partially received within the substantially hollow recess formed by clamp member 300. Put another way, when the longitudinal axes of said base member assembly 200 and clamp member assembly 300 are aligned, said clamp member assembly 300 substantially fits over and covers said base member assembly 200. Central aperture 304, located substantially at the mid-point between said first end 301 and second end 302 of clamp member assembly 300, extends through said upper surface 303 of clamp member assembly 300.

Still referring to FIG. 10, elongate threaded bolt 400, having multi-sided head 404 and threaded section 405, is received through aligned aperture 204 of base member assembly 200 and central aperture 304 of clamp member assembly 300. Washer 403 is received on bolt 400 and is disposed between wing nut 402 and upper surface 303 of clamp member assembly 300. When wing nut 402 is tightened on threaded section of 405 of bolt 400, clamp member assembly 300 and base member assembly 200 are drawn together. Conversely, when said wing nut 402 is loosened on threaded section 405 of said elongate bolt 400, said clamp member assembly 300 can be separated from said base member assembly 200 (at least as far as the length of threaded section 405 of elongate bolt 400).

In the preferred embodiment, clamp member assembly 300 has concave lower surface 305 along both lateral sides of said clamp member assembly 300. Further, in the preferred embodiment, ends 305A are tapered so that said ends do not sit in flush relationship against the substantially flat outer surface of building 11.

Figure 11:
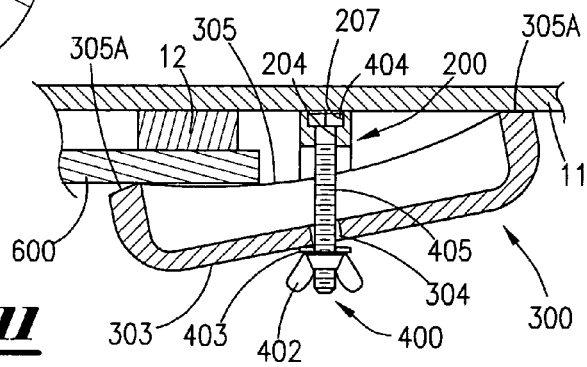
FIG. 11 depicts a side sectional view of the mounting apparatus of the present invention depicted in FIG. 6 along line 11-11.

FIG. 11 depicts a side sectional view of the mounting apparatus of the present invention depicted in FIG. 7 along line 11-11. Elongate threaded bolt 400, having multi-sided head 404 and threaded section 405, is received through aligned aperture 204 of base member assembly 200 and central aperture 304 of clamp member assembly 300. Washer 403 is received on bolt 400 and is disposed between wing nut 402 and upper surface 303 of clamp member assembly 300. Multi-sided head 404 of bolt 400 is received within receptacle 207 on the underside of base member assembly 200, which prevents bolt 400 from spinning or rotating when wing nut 402 is rotated (tightened or loosened) on said bolt 400.

When wing nut 402 is tightened on threaded section of 405 of bolt 400, clamp member assembly 300 and base member assembly 200 are drawn together. Clamp member assembly and, more particularly, a portion of concave lower surface 305 of clamp member assembly 300, acts against panel 600 and functions by wedging said panel 600 against window frame 12.

In this configuration, clamp member assembly 300 is tilted or skewed relative to base member assembly 200. Put another way, the longitudinal axis of clamp member assembly 300 is not parallel to the planar outer surface of building 11. Rather, said clamp member assembly is tilted within base member assembly 200, which allows said clamp member assembly 300 to account for the thickness of frame 12 and panel 600. With clamp member assembly 300 positioned in this fashion, tapered lower surface 305A of clamp member assembly can sit flush against the substantially planar outer surface of building 11.

The components of the present invention can be constructed using any number of different materials. In the preferred embodiment, said components are formed from molded polymeric or plastic material(s), and may include beneficial reinforcing additives. Alternatively, said components can be fashioned from substance(s) such as, for example, metal, wood or other materials, as long as such materials provide the desired characteristics for a particular application.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for mounting a protective panel to a building comprising:

a) an elongate base attached to said building, said base having a first end, a second end and a length, comprising:
   i) a first projection disposed near said first end;
   ii) a second projection disposed near said second end;
   iii) a first bore extending through said first projection and elongate base, wherein said first bore is oriented perpendicular to the longitudinal axis of said elongate base;
   iv) a second bore extending through said second projection and elongate base, wherein said second bore is oriented perpendicular to the longitudinal axis of said elongate base; and
   v) a central bore extending through said elongate base between said first and second projections;

b) an elongate clamping member having a first end, a second end and a length, comprising a substantially planar top, interconnecting side walls extending from said top and defining a cavity within said walls, and a bore extending through said top, wherein said elongate clamping member is oriented substantially perpendicular to the longitudinal axis of said elongate base; and c) a bolt disposed through the central bore of said elongate base and the bore of said clamping member; and d) a nut threadably received on said bolt.

2. The apparatus of claim 1, wherein the bottom edges of said interconnecting side walls along the long sides of said elongate clamping member are concave.

3. The apparatus of claim 1, further comprising a recess along the bottom of said base for receiving the head of said bolt, wherein said bolt is prevented from rotating about its longitudinal axis.

4. An apparatus for mounting plywood to a building to cover an opening in said building comprising:

a) an elongate base, attached to said building adjacent to the opening to be covered by said plywood, having a first end, a second end and a length, comprising:
   i) a first projection disposed near said first end, a second projection disposed near said second end and a gap between said first and second projections;
   iii) a first bore extending through said first projection and elongate base, wherein said first bore is oriented perpendicular to the longitudinal axis of said elongate base;
   iv) a second bore extending through said second projection and elongate base, wherein said second bore is oriented perpendicular to the longitudinal axis of said elongate base; and
   v) a central bore extending through said elongate base between said first and second projections;

b) an elongate clamping member having a first end, a second end and a length, wherein said elongate clamping member is disposed in the gap between said first and second projections and oriented substantially perpendicular to the longitudinal axis of said elongate base, said first end of said clamping member is disposed over said plywood and said second end of said clamping member contacts said building; and c) a bolt, having a head, disposed through a bore of said elongate base and the bore of said clamping member; and d) a nut threadably received on said bolt.

5. The apparatus of claim 4, wherein the bottom of said elongate clamping member is concave along its longitudinal axis.

6. The apparatus of claim 4, further comprising a recess along the bottom of said base for receiving the head of said bolt, wherein said bolt is prevented from rotating about its longitudinal axis.

* * * * *